US009567864B2

(12) United States Patent
Iurisci et al.

(10) Patent No.: US 9,567,864 B2
(45) Date of Patent: Feb. 14, 2017

(54) CENTRIFUGAL IMPELLER AND TURBOMACHINE

(75) Inventors: Giuseppe Iurisci, Florence (IT); Riccardo Brogelli, Florence (IT)

(73) Assignee: Nuovo Pignone SPA, Florence (IT)

( * ) Notice: Subject to any disclaimer, the term of this patent is extended or adjusted under 35 U.S.C. 154(b) by 465 days.

(21) Appl. No.: 14/234,731

(22) PCT Filed: Jul. 20, 2012

(86) PCT No.: PCT/EP2012/064341

§ 371 (c)(1),
(2), (4) Date: Jan. 24, 2014

(87) PCT Pub. No.: WO2013/014106

PCT Pub. Date: Jan. 31, 2013

(65) Prior Publication Data

US 2014/0169954 A1 Jun. 19, 2014

(30) Foreign Application Priority Data

Jul. 26, 2011 (IT) ..... CO2011A0029

(51) Int. Cl.
*F01D 11/02* (2006.01)
*F04D 29/16* (2006.01)
*F01D 5/04* (2006.01)

(52) U.S. Cl.
CPC ..... *F01D 11/02* (2013.01); *F01D 5/043* (2013.01); *F04D 29/162* (2013.01)

(58) Field of Classification Search
CPC ..... F01D 11/02; F01D 5/043; F04D 29/162
USPC ..... 415/173.5, 174.5, 206
See application file for complete search history.

(56) References Cited

U.S. PATENT DOCUMENTS 1,651,855 A * 12/1927 Warren ..... F01D 11/02 277/413
2,851,289 A * 9/1958 Pedersen ..... F04D 29/167 277/415
2,936,175 A * 5/1960 Zuercher ..... A63D 5/08 294/87.22

(Continued)

FOREIGN PATENT DOCUMENTS

CN 2541637 Y 3/2003
FR 2199386 4/1974

(Continued)

OTHER PUBLICATIONS

Italian Search Report from corresponding Italian Patent Application No. CO20110029, dated Feb. 9, 2012.

(Continued)

*Primary Examiner* — Hoang Nguyen
(74) *Attorney, Agent, or Firm* — GE Global Patent Operation

(57) ABSTRACT

A centrifugal turbomachine comprising a casing, a rotor assembly comprising at least one centrifugal impeller for a fluid flowing from an inlet side to an outlet side of the impeller, and an eye seal extending between an impeller eye of the centrifugal impeller and the casing for preventing the fluid from leaking between the casing and the centrifugal impeller, wherein the eye seal comprises at least a first portion toward the inlet side and a last portion toward the outlet side of the impeller, the last portion being smaller in diameter than the first portion.

10 Claims, 5 Drawing Sheets

(56) References Cited

U.S. PATENT DOCUMENTS

| | | | | |
|---|---|---|---|---|
| 3,105,632 | A | 10/1963 | Tanzberger | |
| 4,152,092 | A * | 5/1979 | Swearingen | F01D 11/02 277/423 |
| 4,472,107 | A * | 9/1984 | Chang | F01D 3/04 415/104 |
| 5,890,873 | A | 4/1999 | Willey | |
| 6,039,535 | A | 3/2000 | Kobayashi | |
| 6,450,765 | B1 | 9/2002 | Carroll et al. | |
| 7,775,763 | B1 | 8/2010 | Johnson et al. | |

FOREIGN PATENT DOCUMENTS

| | | | |
|---|---|---|---|
| GB | 775456 | | 5/1957 |
| JP | 62044180 | U1 | 3/1987 |
| JP | 64083891 | A | 3/1989 |
| JP | 6-249186 | A | 9/1994 |
| JP | 7-71398 | A | 3/1995 |
| JP | 2002228014 | A | 8/2002 |
| RU | 243456 | C1 | 11/2010 |

OTHER PUBLICATIONS

International Search Report from corresponding PCT Application No. PCT/EP2012/064341, dated Oct. 5, 2012.

Written Opinion from corresponding PCT Application No. PCT/EP2012/064341, dated Oct. 5, 2012.

Unofficial English Translation of Chinese Office Action issued in connection with corresponding CN Application No. 201280036791.2 on Nov. 25, 2014.

Unofficial English translation of Notice of Allowance issued in connection with corresponding RU Application No. 2014100858 dated Jun. 1, 2016.

Unofficial English translation of Office Action issued in connection with corresponding JP Application No. 2014522048 dated Jun. 7, 2016.

* cited by examiner

CENTRIFUGAL IMPELLER AND TURBOMACHINE

BACKGROUND OF THE INVENTION

The present invention relates to centrifugal turbomachines, to centrifugal impellers for turbomachines and to the related production methods, particularly, but not exclusively, for oil and gas applications.

A centrifugal turbomachine is a rotary machine where mechanical energy is transferred between a working fluid and a centrifugal impeller. In oil and gas application, where the fluid is typically a gaseous fluid, centrifugal turbomachines include compressors and expanders. A compressor is a turbomachine which increases the pressure of a gaseous fluid through the use of mechanical energy. An expander is a turbomachine which uses the pressure of a working gaseous fluid to generate mechanical work on a shaft by using an impeller in which the fluid is expanded.

In uncompressible fluid, e.g., water, centrifugal turbomachines include pumps and turbines, which transfer energy between the fluid and the impeller in a way analogous to compressors and expanders, respectively.

In general, in all cases, the working fluid exchanges energy with the centrifugal machine by flowing in the centrifugal impeller along a radial outward direction, oriented from an axis of rotation of the impeller to a peripheral circumferential edge of the impeller.

In particular, the centrifugal impeller of a compressor turbomachine transfers the mechanical energy supplied by a motor that drives the turbomachine to the working gaseous fluid being compressed by accelerating the fluid in the centrifugal impeller. The kinetic energy imparted by the impeller to the working fluid is transformed into pressure energy when the outward movement of the fluid is confined by a diffuser and the machine casing.

Centrifugal turbomachines can be fitted with a single impeller, in which case they are frequently referred to as single stage turbomachines, or with a plurality of impellers in series, in which case they are frequently referred to as multistage centrifugal turbomachines.

A prior art embodiment of a multistage centrifugal compressor 100 is illustrated in FIG. 1, in an overall section view, and in FIGS. 2 and 3, in more detailed section views. Compressor 100 is included in a casing 102 within which is mounted a shaft 101 and a plurality of impellers 110. The shaft extends along an axis of rotation X of compressor 100. The shaft 101 and impellers 110 are included in a rotor assembly 103 that is supported through a couple of bearings 150 and 160, which allow the rotor assembly to rotate around the axis of rotation X. The multistage compressor 100 comprises a plurality of stages 107 (seven stages 107 in the embodiment in FIG. 1), each stage 107 including one impeller of the plurality of impellers 110 and a portion of the casing 102, where an inlet duct 170 upstream the impeller 110 and an outlet duct 180 downstream the impeller 110 are provided. The impeller 110 has a typical closed design configuration including an impeller hub 113, which closely encircles the shaft 101, and a plurality of blades 108 extending between a rear impeller disc 114 and a front shroud 119. The impeller 110 comprises an inlet low-pressure side 111 defined by an impeller eye 115 on the front shroud 109 and an outlet high-pressure side 112 defined by a peripheral circumferential edge of the impeller 110.

Through operation of the impeller 110, each stage 107 of the multistage compressor 100 operates to take an input process gas flowing along the inlet duct 170, to drive the gas from the inlet low-pressure side 111 to the outlet high-pressure side 112 of the impeller 110 and to subsequently expel the process gas through the outlet duct 180 at an output pressure which is higher than its input pressure.

The process gas may, for example, be any one of carbon dioxide, hydrogen sulfide, butane, methane, ethane, propane, liquefied natural gas, or a combination thereof.

An impeller eye seal 120 is provided between the impeller eye 115 of each centrifugal impeller 110 and the casing 102, in order to prevent the fluid from leaking in the space between the casing 102 and the impeller 110, from the outlet high-pressure side 112 to the inlet low-pressure side 111. The casing 102 includes an inlet ring 104 facing the impeller eye 105 and provided with a cavity for housing the impeller eye seal 120.

The impeller eye seal 120 is of the labyrinth type with a plurality of teeth 121*a-e* (five teeth 121*a-e* in the embodiment in FIGS. 1-3). Each tooth 121*a-e* extends radially towards the axis of rotation X and circumferentially around the axis of rotation X. The envelope profile of the teeth 121*a-e* is conical in shape with a mean diameter 122. The eye seal 120 is mounted on a housing in the casing 102 and placed in such a way that a first tooth 121*a* toward the inlet low-pressure side 111 is smaller in diameter than a last (fifth) tooth 121 e toward the outlet high-pressure side 111. To match the shape of impeller eye seal 120, the impeller eye 115 is provided with a stepped region 116 comprising a plurality of steps 117*a-e* (five steps 117*a-e* in the embodiment in FIGS. 1-3), each facing a respective tooth of the plurality of teeth 121*a-e*. The plurality of steps 117*a-e* includes a first step 117*a* toward the inlet low-pressure side 111 having a diameter 123*a* which is smaller than the diameter 123*e* of a last (fifth) step 117*e* toward the outlet high-pressure side 112 of the impeller 110.

Fluid leakages through the eye seal 120 must be reduced as much as possible for the reason that the portion of fluid leaking from the outlet to the inlet side has to be compressed again through the impeller, thus reducing the efficiency of the turbomachine.

An impeller having the same design of impeller 110 can be used also in an expander, the main difference being the fact that the gaseous fluid expands in the impeller, i.e., the inlet side, corresponding to the impeller eye, is the high-pressure side while the outlet side, corresponding to the peripheral circumferential edge is the low-pressure side. In an expander the impeller eye seal prevents the fluid from leaking in the space between the casing and the impeller, from the inlet high-pressure side to the inlet low-pressure side. Fluid leakages through the eye seal must be reduced as much as possible also in an expander, for the reason that the portion of fluid leaking from the inlet to the outlet side does not flow through the impeller and therefore does not contribute to generate mechanical work on the shaft, thus reducing the efficiency of the turbomachine.

It would be desirable to design and provide an improved sealing system for reducing the leakage flow through the impeller eye of a centrifugal impeller.

BRIEF SUMMARY OF THE INVENTION

An object of the present invention is to produce a centrifugal turbomachine and a centrifugal impeller providing an improved impeller eye sealing system to reduce the leakage flow between a casing of the turbomachine and the impeller.

According to a first embodiment, the present invention accomplish the object by providing a centrifugal turbomachine comprising a casing; a rotor assembly including at least one centrifugal impeller for a fluid flowing from an inlet side to an outlet side of the impeller; an eye seal extending between an impeller eye of the centrifugal impeller and the casing for preventing the fluid from leaking between the casing and the centrifugal impeller; wherein the eye seal have at least a first portion toward the inlet side and a last portion toward the outlet side of the impeller, the last portion being smaller in diameter than the first portion.

According to a further feature of the first embodiment , the eye seal is of the labyrinth type with a plurality of teeth extending in a radial direction toward an axis of rotation of the impeller.

According to further features of the first embodiment, the labyrinth eye seal is mounted on an inlet ring of the casing facing a stepped region of the impeller eye having at least a first step toward the suction side and a last step toward the outlet side of the impeller, the last step being smaller in diameter than the first step; the number of teeth of the eye seal equalling the number of steps of the stepped region of the impeller eye, the eye seal being mounted on the inlet ring of the casing in such a way that each tooth of the eye seal faces a respective step of the impeller eye.

According to a further feature of the first embodiment, the number of steps of the stepped region of the impeller eye is between 4 and 10.

According to a further feature of the first embodiment, the centrifugal impeller is of the shrouded type, the stepped region of the impeller eye being provided on a shroud of the centrifugal impeller.

According to a further feature of the first embodiment, the centrifugal turbomachine is a compressor, the inlet side of the impeller being at lower pressure than the outlet side.

In a second embodiment, the present invention provides a centrifugal impeller for a centrifugal turbomachine comprising an impeller eye having a stepped region with at least a first step toward an inlet side and a last step toward an outlet side of the centrifugal impeller, the last step being smaller in diameter than the first step.

The design of the impeller eye and the mounting of the impeller eye seal in the above embodiments allows to reduce the mean diameter of impeller eye and of the impeller eye seal without reducing the diameter of the inlet of the impeller, i.e. without modifying the gas flow through the impeller. Being the fluid leakage through the impeller eye proportional to the mean diameter of impeller eye, the reduction of such diameter results in a reduction of the fluid leakage, thus accomplishing the object of the present invention.

Further advantages are determined by the reduction of the impeller weight which the new design according to the present invention allows. A lighter impeller permits to improve the rotordynamic characteristics of the impeller and to more easily balance the axial thrusts.

A further object of the present invention is to develop a method for the production of the turbomachine and the impeller.

According to a third embodiment, the present invention accomplishes this further object by providing a method for reducing leakages through an eye seal in a centrifugal turbomachine having a casing a rotor assembly including at least one centrifugal impeller for a fluid flowing from an inlet side to an outlet side of the impeller, an eye seal extending between an impeller eye of the centrifugal impeller and the casing for preventing the fluid from leaking between the casing and the centrifugal impeller; the eye seal having at least a first portion and a last portion being smaller in diameter than the first portion; wherein the method comprises the step of mounting the labyrinth eye seal with the first portion toward the inlet side and the last portion) toward the outlet side of the impeller.

The same advantages described above with reference to the first and second embodiment of the present invention are accomplished by the third embodiment.

BRIEF DESCRIPTION OF THE DRAWINGS

Other object feature and advantages of the present invention will become evident from the following description of the embodiments of the invention taken in conjunction with the following drawings, wherein.

DETAILED DESCRIPTION OF THE EXEMPLARY EMBODIMENTS OF THE INVENTION

Figure 4:
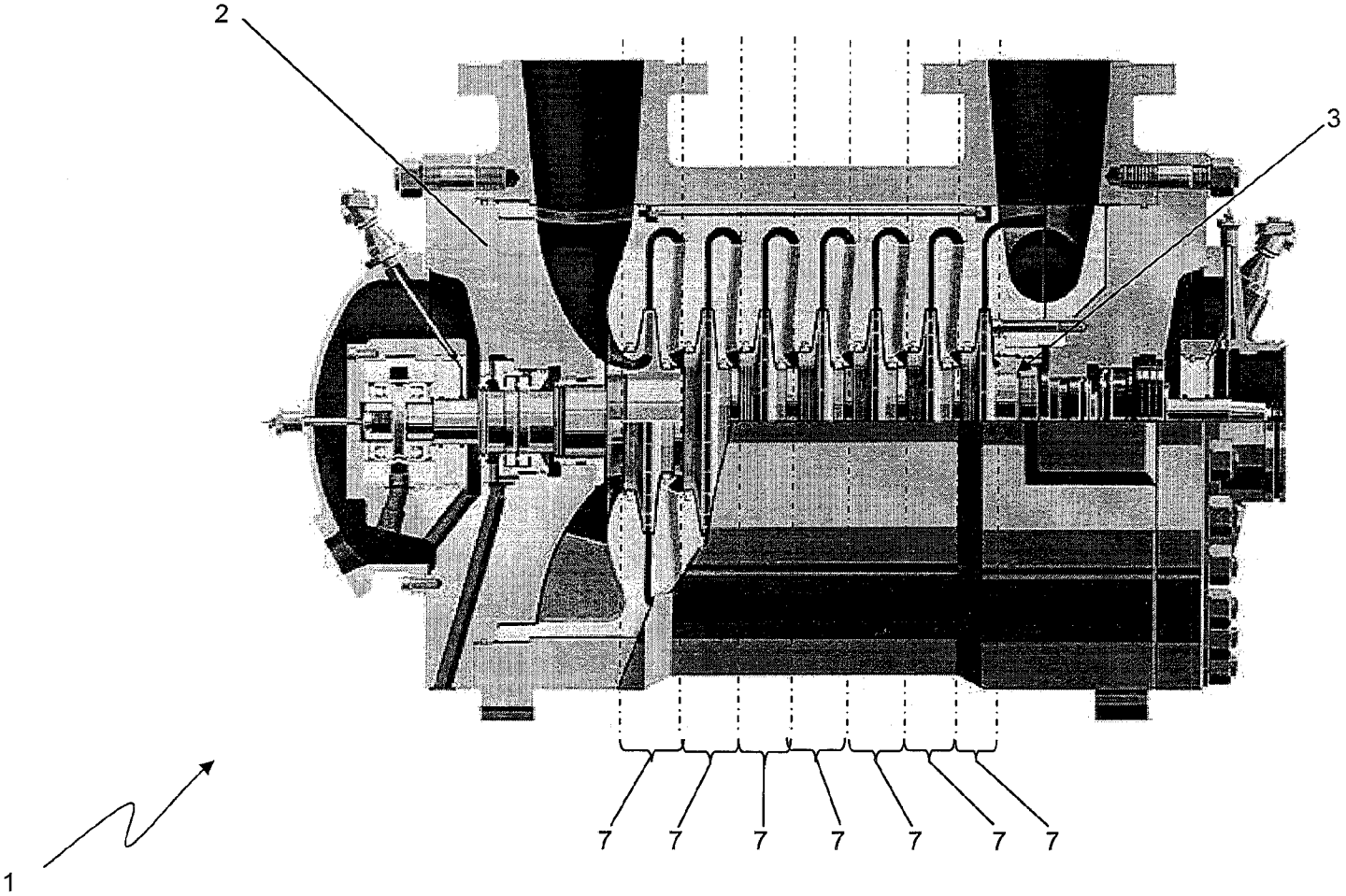
FIG. 4 is a longitudinal sectional view of a centrifugal turbomachine according to an embodiment of the present invention.
Figure 5:
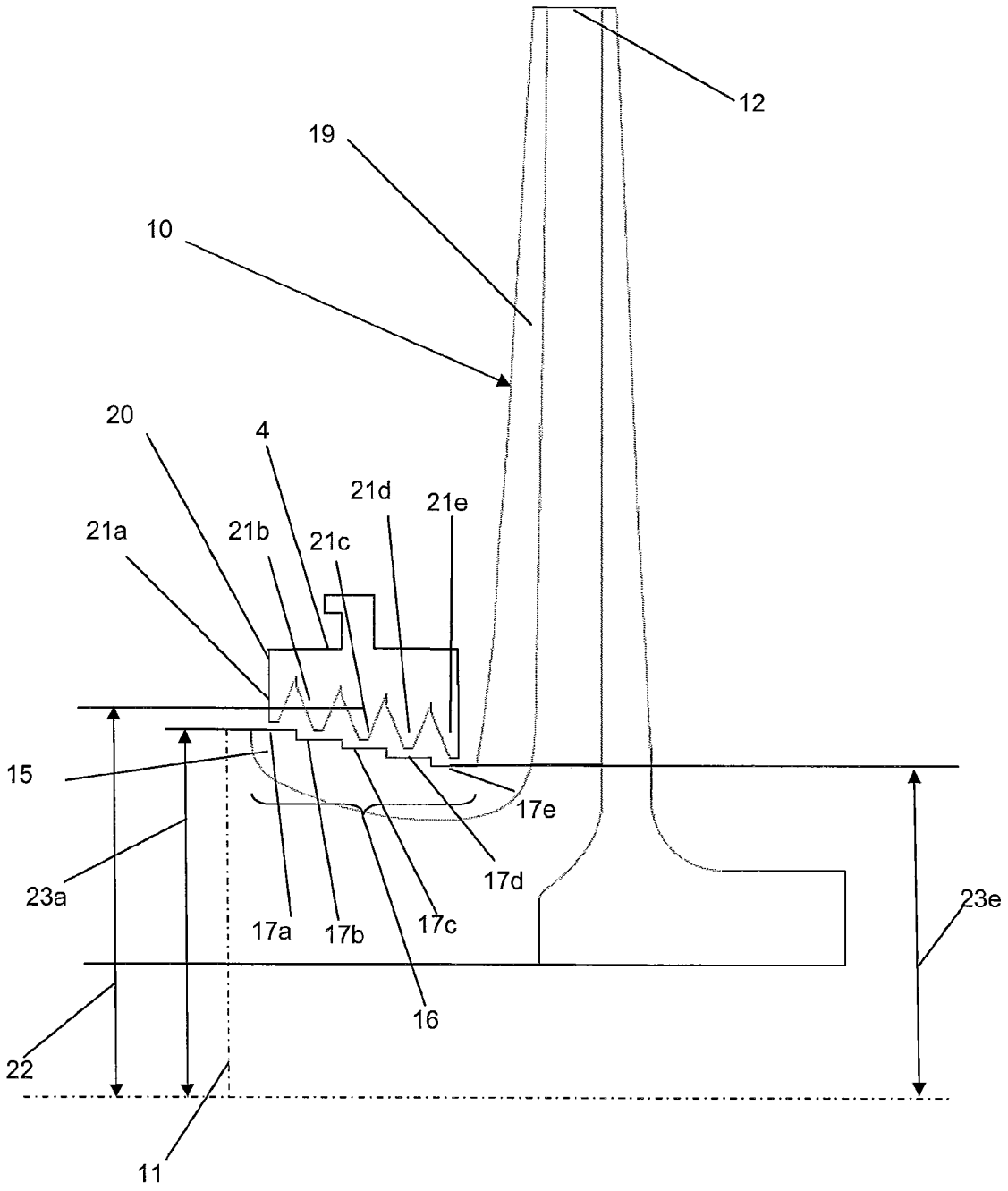
FIG. 5 is a longitudinal sectional view, corresponding to the view in FIG. 3, showing a centrifugal impeller, according to an embodiment of the present invention, of the centrifugal turbomachine in FIG. 3.

A first and a second embodiment of the present invention are shown in FIGS. 4 and 5, respectively.

Figure 1:
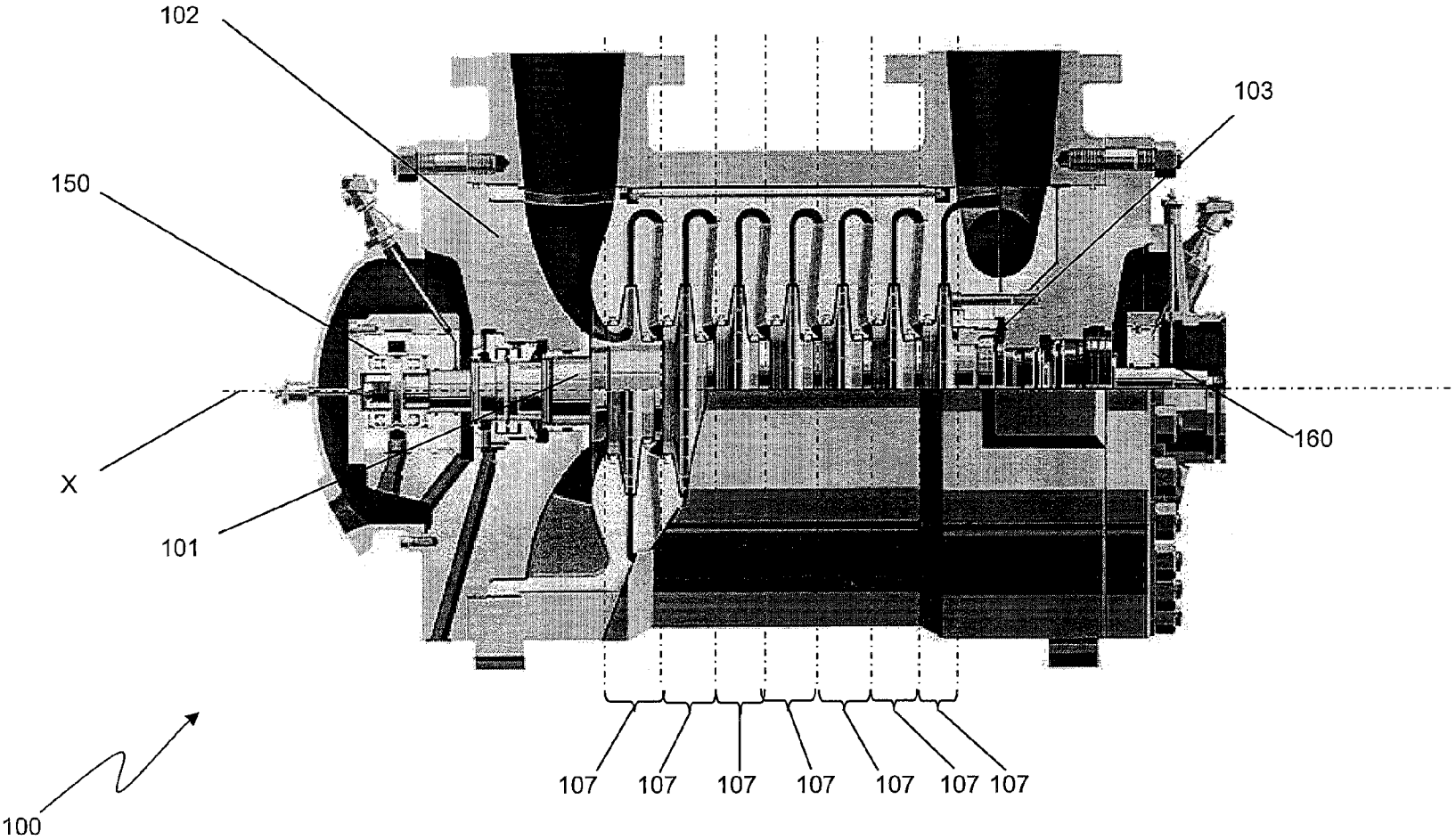
Fig. 1 (PRIOR ART)
FIG. 1 is a longitudinal sectional view of a conventional centrifugal turbomachine.
Figure 2:
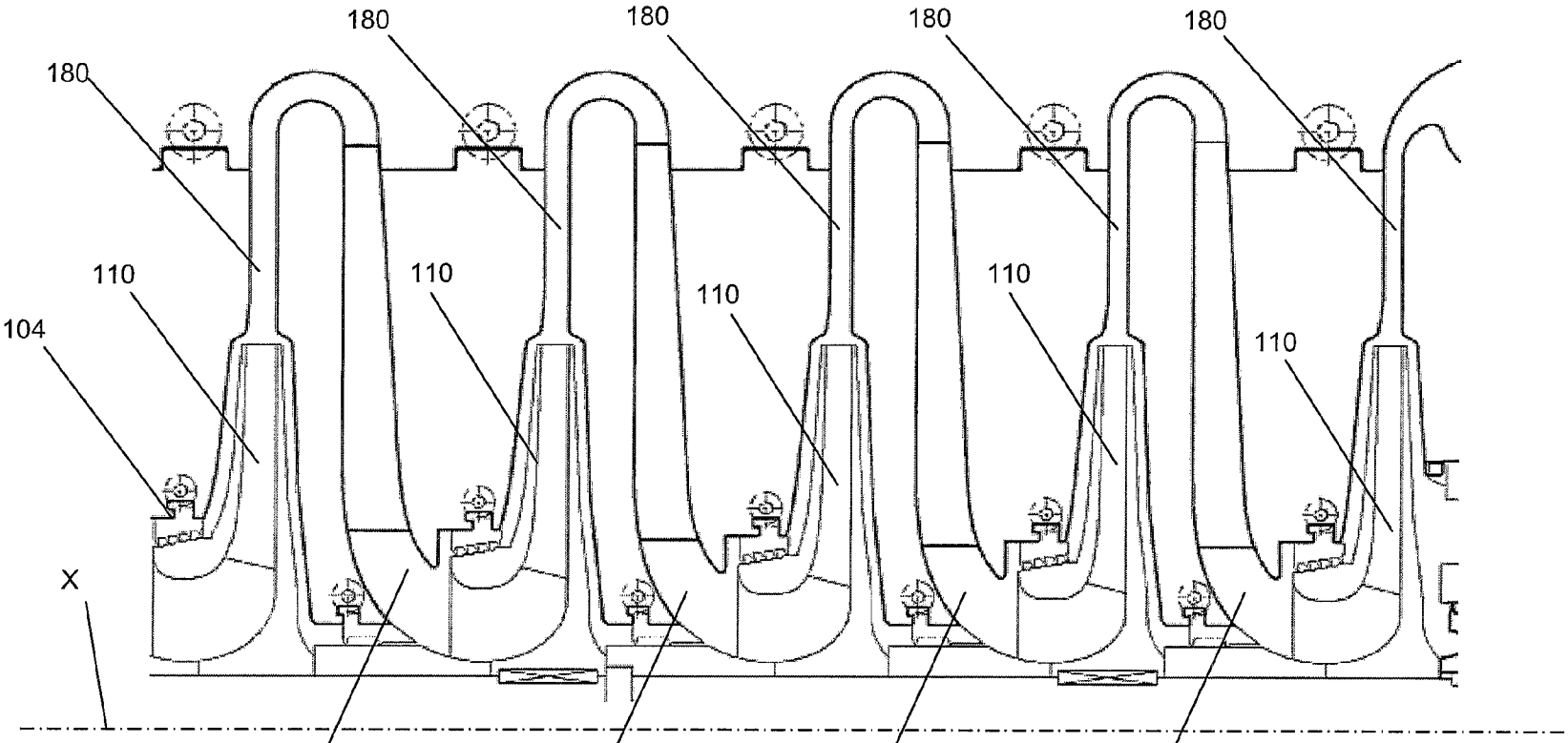
Fig. 2 (PRIOR ART)
FIG. 2 is a longitudinal sectional view showing an essential portion of the centrifugal turbomachine in FIG. 1.

With reference to FIG. 4, a centrifugal turbomachine 1 is constituted by a centrifugal multistage compressor comprising a statoric casing 2 and a rotor assembly 3. The casing 2 and the rotor assembly 3 are subdivided into a plurality (seven) of stages 7 connected in series. For parts which are not described in the following, the compressor 1 must be considered conventional and identical to compressor 100 in FIGS. 1-3, described above.

Each stage 7 includes a centrifugal impeller 10 for a gaseous fluid flowing from an inlet low-pressure side 11 to an outlet high-pressure side 12 of the impeller 10. The centrifugal impeller 10 is of the shrouded type, comprising a shroud 19 on which an impeller eye 15 of the impeller 10 is provided. The impeller eye 15 defines the inlet low-pressure side 11, through which the fluid enters the impeller 10 along a direction substantially parallel to an axis of rotation X of the impeller 10. The outlet high-pressure side 12 through which the fluid leaves the impeller 10 is defined by a peripheral circumferential edge of the impeller 10.

Each stage 7 further includes an eye seal 20 of the labyrinth type extending between the impeller eye 15 of the centrifugal impeller 10 and an inlet ring 4 of the casing 2 for preventing the fluid from leaking between the casing 2 and the centrifugal impeller 10, from the outlet high-pressure side 12 to the inlet low-pressure side 11.

The labyrinth eye seal 20 has a plurality of teeth 21*a-e* (five teeth 21*a-e* in the embodiment of FIGS. 4 and 5) extending in a radial direction toward the axis of rotation X of the impeller 10 and in a circumferential direction around the axis of rotation X. The envelope profile of the teeth 21*a-e* is conical in shape with a mean diameter 22. The plurality of teeth 21*a-e* comprises a first tooth 21 a toward the inlet side 11 and a last tooth 21 e toward the outlet side 12 of the impeller 10, the last tooth 21*e* being smaller in diameter than the first portion 21*a*.

The labyrinth eye seal 2 is mounted on a cavity on the inlet ring 4 of the casing 2 facing a stepped region 16 of the impeller eye 15. The stepped region 16 comprises a first step 17*a* toward the suction side and a last step 17*e* toward the outlet side of the impeller 10. To match the profile of the labyrinth eye seal 20, the last step 17*e* has a diameter 23*e* which is smaller than a corresponding diameter 23*a* of the first step 17*a* of the stepped region 16.

In an embodiment, the number of teeth 21*a-e* of the eye seal 20 equals the number of steps 17*a-e* of the stepped region 16 of the impeller eye 15, the eye seal 20 being mounted on the inlet ring 4 in such a way that each tooth of the plurality of teeth 21 *a-e* of the eye seal 20 faces a respective step of the plurality of steps 17*a-e* of the impeller eye 15.

In an embodiment, the number of steps 17*a-e* of the stepped region 16 and the number of teeth 21*a-e* of the labyrinth eye seal 20 are between 4 and 10.

The present invention can be used also in centrifugal expanders applications, where the eye seal prevents a gaseous fluid from leaking between the casing and the centrifugal impeller, from an inlet high-pressure side to an outlet low-pressure side.

More in general, the present invention can be used also in centrifugal turbomachines for compressible and uncompressible fluids, the latter turbomachines including pumps and water turbines.

Figure 3:
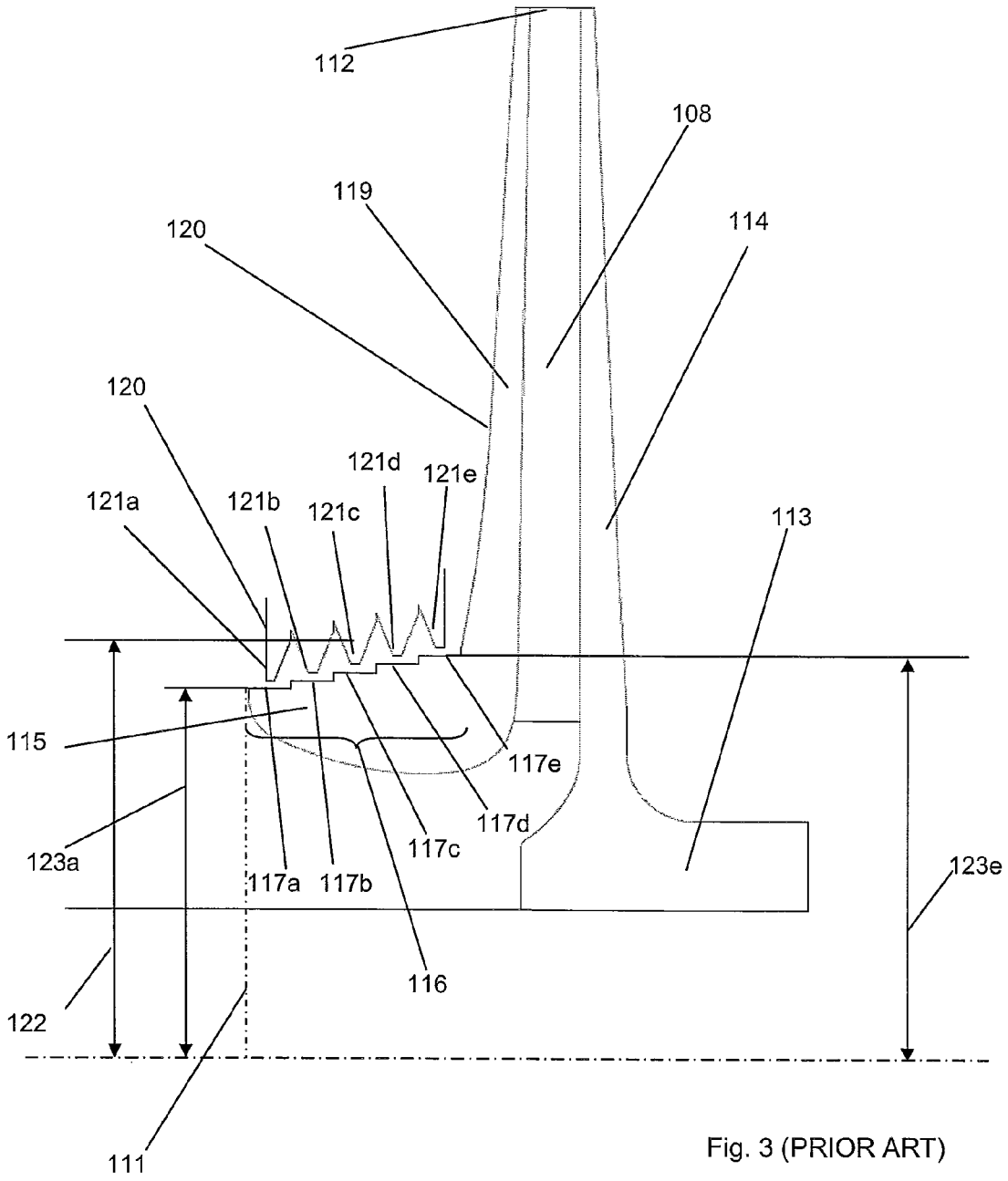
Fig. 3 (PRIOR ART)
FIG. 3 is a longitudinal sectional view showing detailed components of the centrifugal turbomachine in FIGS. 1 and 2.

By comparing the conventional solution in FIG. 3 with the solution according to an embodiment in FIG. 5 it is evident that, when the values of the diameters of the first steps 117*a*, 17*a* of the stepped regions 116, 16 are the same, the value of the mean diameter 22 of the impeller eye seal 20 is lower than the mean diameter 122 of the conventional impeller eye seal 120. This results in a reduced leakage flow through the impeller eye seal 20.

By further comparing the conventional centrifugal impeller 110 (FIG. 3) with the centrifugal impeller 10 of the present invention (FIG. 5) it is also evident that, when the two impellers 110, 10 have the same flow geometry, the weight of the impeller 10 is lower than the weight of the impeller 110. Indeed, when the values of the diameters of the first steps 117*a*, 17*a* of the stepped regions 116, 16 are the same, the values of the diameters of the second to fifth step 17*b-e* of the stepped region 16 are lower than the values of the diameters of the second to fifth step 117*b-e* of the conventional stepped region 16. This results in a reduction of weight which is typically around 10%. As a consequence of the reduced weight, the centrifugal impeller 10 shows improved rotordynamic properties and an improved balance of the axial thrusts.

According to a third embodiment of the present invention, a method for reducing leakages through the eye seal 20 of the centrifugal turbomachine 1 above described comprises the step of mounting the labyrinth eye seal 20 with the first tooth 21 a toward the inlet side 11 and the last portion 21*e* toward the outlet side 12 of the centrifugal impeller 10.

All the embodiments of the present invention allows to accomplish the object and advantages cited above.

In addition the present invention allows to reach further advantages. In particular, the method above described can be used in refurbishing the conventional turbomachine 100 by substituting the plurality of centrifugal impellers 110 and a plurality of eye seals 120 with a plurality of impellers 10 and with a plurality of eye seals 20, thus obtaining the turbomachine 1 of the present invention, without modifying the other components of the conventional turbomachine.

In general, for all the embodiment of the present invention, a further advantage resides in the fact that if the geometrical parameters of the stepped region 16, i.e., height and width of the steps, are the same of conventional application, the same eye seals used in conventional application can still be used, by simply turning them by 180° and mounting them on the inlet ring of the casing with the tooth having the greater diameter toward the inlet side of the impeller.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements with insubstantial differences from the literal languages of the claims.

The invention claimed is:

1. A centrifugal turbomachine comprising:

a casing;

a rotor assembly comprising at least one centrifugal impeller for a fluid flowing from an inlet side to an outlet side of the impeller; and an eye seal extending between an impeller eye of the centrifugal impeller and the casing for preventing the fluid from leaking from an high pressure side to a low pressure side of the impeller, wherein the eye seal comprises at least a first portion toward the inlet side and a last portion toward the outlet side of the impeller, wherein an envelope profile of the eye seal has a conical shape and a diameter of the last portion is smaller than a diameter of the first portion.

2. The centrifugal turbomachine according to claim 1, wherein the eye seal is of the labyrinth type with a plurality of teeth extending in a radial direction toward an axis of rotation of the impeller.

3. The centrifugal turbomachine according to claim 1, wherein the eye seal is mounted on an inlet ring of the casing facing a region of the impeller eye the impeller eye at least a first portion toward the suction side and a last portion toward the outlet side of the impeller, and the last portion is smaller in diameter than the first portion.

4. The centrifugal turbomachine according to claim 2, wherein the labyrinth eye seal is mounted on an inlet ring of the casing facing a stepped region of the impeller eye, the impeller eye comprises at least a first step toward the suction side and a last step toward the outlet side of the impeller, and the last step is smaller in diameter than the first step.

5. The centrifugal turbomachine according to claim 4, wherein the number of teeth of the eye seal equals the number of steps of the stepped region of the impeller eye, the eye seal being mounted on the inlet ring of the casing in such a way that each tooth of the eye seal faces a respective step of the impeller eye.

6. The centrifugal turbomachine according to claim 5, wherein the number of steps of the stepped region is between 4 and 10.

7. The centrifugal turbomachine according to claim 4, wherein the centrifugal impeller is of the shrouded type, the stepped region of the impeller eye being provided on a shroud of the centrifugal impeller.

8. The centrifugal turbomachine according to claim 1, wherein the centrifugal turbomachine is a compressor, the inlet side of the impeller being at lower pressure than the outlet side.

9. A centrifugal impeller for a centrifugal turbomachine, the centrifugal impeller comprising:

an impeller eye comprising a stepped region comprising at least a first step toward an inlet side of the centrifugal impeller and a last step toward an outlet side of the centrifugal impeller, wherein an envelope profile of the eye seal has a conical shape and a diameter of the last portion is smaller than a diameter of the first portion.

10. A method for reducing leakages through an eye seal in a centrifugal turbomachine, wherein the turbomachine comprises a casing, a rotor assembly comprising at least one centrifugal impeller for a fluid flowing from an inlet side to an outlet side of the impeller, and the eye seal extending between an impeller eye of the centrifugal impeller and the casing for preventing the fluid from leaking between the casing and the centrifugal impeller, wherein the eye seal comprises at least a first portion adjacent to the inlet side and a last portion adjacent to the outlet side, the method comprising:

providing an envelope profile of the passage of the eye seal according to a conical shape with the first portion toward the inlet side of the impeller corresponding to a greater passage diameter and the last portion toward the outlet side of the impeller corresponding to a smaller passage diameter.

* * * * *